United States Patent [19]

Gray

[11] 4,384,932

[45] * May 24, 1983

[54] CATHODE FOR CHLOR-ALKALI CELLS

[75] Inventor: Thomas J. Gray, Guilford, Conn.

[73] Assignee: Olin Corporation, New Haven, Conn.

[ * ] Notice: The portion of the term of this patent subsequent to Dec. 23, 1997, has been disclaimed.

[21] Appl. No.: 329,094

[22] Filed: Dec. 9, 1981

Related U.S. Application Data

[63] Continuation-in-part of Ser. No. 179,150, Aug. 18, 1980, Pat. No. 4,370,361, which is a continuation-in-part of Ser. No. 25,153, Mar. 29, 1979, Pat. No. 4,240,895.

[51] Int. Cl.[3] ..... C25B 1/34; C25B 11/06; C25B 11/10

[52] U.S. Cl. ..... 204/98; 204/128; 204/252; 204/290 R; 204/290 F; 204/293

[58] Field of Search ..... 204/290 R, 290 F, 293, 204/252, 98, 128

[56] References Cited

U.S. PATENT DOCUMENTS

| | | | |
|---|---|---|---|
| 4,049,841 | 9/1977 | Coker et al. | 427/423 |
| 4,116,804 | 9/1978 | Needes | 204/290 R |
| 4,169,025 | 9/1979 | Needes | 204/290 R |
| 4,240,895 | 12/1980 | Gray | 204/290 R |
| 4,248,680 | 2/1981 | Carlin et al. | 204/98 |
| 4,251,478 | 2/1981 | Welch et al. | 204/98 |

*Primary Examiner*—R. L. Andrews

*Attorney, Agent, or Firm*—Arthur E. Oaks; Donald F. Clements

[57] ABSTRACT

An improved cathode with a conductive metal core and a Raney nickel type catalytic surface predominantly derived from an adherent Beta ($NiAl_3$) crystalline precursory outer portion of the metal core is disclosed. The precursory outer portion contains nickel, tantalum, and aluminum to give a precursor alloy having the formula $(NiTa)Al_3$ where the tantalum content of the nickel-tantalum portion is in the range of from about 5 to about 25 weight percent. Also disclosed is a method of producing a low overvoltage cathode which includes the steps of coating a nickel-tantalum core or substrate having from about 5 to about 25 percent by weight of tantalum with molten aluminum and heat treating the coated substrate to form a $(NiTa)Al_3$ ternary alloy with predominantly a Beta crystal structure on the outer portion. An alkali metal hydroxide is used to leach out aluminum and produce a porous binary Raney Ni-Ta alloy surface. The resulting porous binary alloy-coated substrate is useful as a cathode in electrolytic cells, particularly in membrane cells utilized to produce chlorine and caustic from brine.

22 Claims, 2 Drawing Figures

CATHODE FOR CHLOR-ALKALI CELLS

This application is a continuation-in-part of my copending application Ser. No. 179,150, filed Aug. 18, 1980, now U.S. Pat. No. 4,370,361, which is a continuation-in-part of Ser. No. 025,153, filed Mar. 29, 1979, now U.S. Pat. No. 4,240,895, which issued Dec. 23, 1980.

FIELD OF INVENTION

The invention relates to an improved Raney nickel cathode for chlor-alkali electrolytic cells and the method for preparing it.

PRIOR ART

In view of the phenomenal increase in energy costs and the increased scarcity of industrial fuel supplies, there has been and continues to be a flurry of research activity in the electrolysis field to find ways to reduce the amount of power used in electrolysis processes. For many years, it has been customary to use steel cathodes in chlor-alkali diaphragm cells, even though a substantial amount of power is used in overcoming what is called "hydrogen overvoltage" at the cathode. Hydrogen overvoltage is largely an inherent characteristic of the metallic surface in contact with the electrolyte so there is a continual need and desire to provide better cathode surfaces to reduce this overvoltage and thereby decrease the power consumption of the cell.

It is known that active, porous nickel can be produced by selectively dissolving a soluble component, such as aluminum or zinc out of an alloy of nickel and the soluble component. A porous nickel of this type and the alloy from which it is produced are generally called "Raney nickel" or "Raney alloy". See U.S. Pat. Nos. 1,563,787, (1925), 1,628,191 (1927) and 1,915,473 (1933) for the description of various methods for producing Raney nickel.

It is also known to use Raney nickel surfaces on cathodes for chlor-alkali cells. For example, U.S. Pat. No. 4,116,804, which issued Sept. 26, 1978, and U.S. Pat. No. 4,169,025, which issued Sept. 25, 1979 to C. Needes and assigned to DuPont de Nemours, described an electrode for use as a hydrogen evolution cathode in electrolytic cells in which a cohesive surface layer of Raney nickel is in electrical contact with a conductive metal core having an outer layer of at least 15 percent nickel characterized in that the surface layer of Raney nickel is thicker than 75 μm and has a mean porosity of at least 11 percent. The catalytic surface layer is derived from grains of the Gamma form, $Ni_2Al_3$, from which at least about 60 percent of aluminum has been leached out with an aqueous base. An overvoltage of about 60 millivolts is alleged for this type of cathode. To phrase the same thing relative to conventional cathodes, reductions of 315 to 345 millivolts in hydrogen overvoltage as compared with mild steel cathodes is alleged. However, subsequent testing indicates much higher overvoltages and actual reductions of only 100–150 millivolts are achieved. Furthermore, spalling or delamination of the coating has been observed upon additional testing. These patents teach that any Raney nickel which forms from the Beta phase, $NiAl_3$, is mechanically weak and does not adhere well and is generally lost during leaching. These patents also teach that $Ni_2Al_3$ (Gamma phase) is the preferred intermetallic precursor and governs the activity of the coating and that the heat treatment should be such that the proportion of $Ni_2Al_3$ is maximized. This reference to mechanical weakness of Raney nickel from the Beta phase is unfortunate because it was previously known that Raney Ni from $NiAl_3$ (Beta phase) is more active for hydrogen desorption than is Raney Ni from $Ni_2Al_3$ (Gamma phase). See, for example, A. A. Zavorin et al., *Kinetika i Kataliz,* which explains hydrogen is more weakly "bonded" in Raney Ni from $NiAl_3$ than from $Ni_2Al_3$, that there are more hydrogen adsorption centers in Raney Ni from $NiAl_3$ than $Ni_2Al_3$ and that the heat of desorption is lower for Raney Ni from $NiAl_3$ than $Ni_2Al_3$.

U.S. Pat. Nos. 4,043,946, which issued Aug. 23, 1977 and 4,049,580, which issued Sept. 20, 1977, each describe Raney nickel-based catalysts. However, the use of these materials as cathodes in electrolytic cells and the effect of such materials on hydrogen overvoltage is not recognized.

Golin, Karaseva and Serykh in *Elektrokhimiya,* Vol. 13, No. 7, pp. 1052–1056 (USSR, July 1977) disclose a 10 percent Mo, 45 percent Ni, 45 percent Al alloy which, upon leaching, yields a Raney catalytic surface with extremely low activation energy for hydrogen oxidation such as would occur in a hydrogen-oxygen fuel cell. No mention of hydrogen evolution (i.e., hydrogen reduction) catalysis is given or suggested.

In addition, U.S. Pat. No. 3,673,116, which issued June 27, 1972, to Richter, discloses mixed Raney nickel catalysts of nickel, iron, and zirconium or titanium for use as a fuel cell electrode.

Other less pertinent prior art is discussed in my parent application, now U.S. Pat. No. 4,240,895 which issued Dec. 23, 1980.

OBJECTS

It is an object of this invention to provide an improved cathode for electrolytic cells.

Another object of this invention is to provide an improved method of preparing cathodes for electrolytic cells.

Still another object of this invention is to provide an improved electrolytic cell containing an improved cathode.

A further object of this invention is to provide an improved method of operating an electrolytic cell utilizing an improved cathode.

These and other objects of the invention are apparent from the following detailed description of the invention.

SUMMARY OF THE INVENTION

The novel electrode of the present invention has a Raney nickel surface layer in electrical contact with a conductive metal core, characterized by the improvement which comprises a porous Raney metal surface of nickel and tantalum which is derived from an adherent Ni-Ta-Al tertiary crystalline precursory outer portion of said metal core. The precursory outer portion is predominently in the Beta phase, having the formula $(NiTa)Al_3$ where the tantalum content is in the range from about 5 to about 25 percent by weight of the nickel-tantalum portion.

The invention further provides a method of producing a low overvoltage electrode for use as a hydrogen evolution cathode in an electrolytic cell, which comprises the steps of:

(a) coating with molten aluminum the surface of a non-porous conductive base metal structure of an alloy comprised of from about 5 to about 25 weight percent of tantalum and from about 75 to about 95 weight percent of nickel;

(b) heat treating said coated surface by maintaining said surface at a temperature in the range from about 660° to about 750° C. for sufficient time to diffuse a portion of said aluminum into outer portions of said structure to produce an integral nickel-tantalum-aluminum alloy layer in predominently the Beta phase, having the empirical formula $(NiTa)Al_3$, but for insufficient time to create a predominance of the Gamma phase, $(NiTa)_2Al_3$ in said outer portions; and (c) leaching out residual aluminum and intermetallics from the alloy layer until a porous Raney nickel-tantalum exterior layer is formed integral with said structure.

This invention further provides an improved method of electrolyzing brine in an electrolytic cell to produce chlorine and caustic, employing as the cathode the novel cathode of this invention having an exterior surface comprised of a porous Raney nickel-tantalum alloy surface. This invention also provides a novel electrolytic cell employing the novel cathode of this invention.

BRIEF DESCRIPTION OF THE DRAWINGS

The invention will be better understood by reference to the attached drawings which are provided by way of illustration.

DETAILED DESCRIPTION OF PREFERRED EMBODIMENTS

Figure 1:
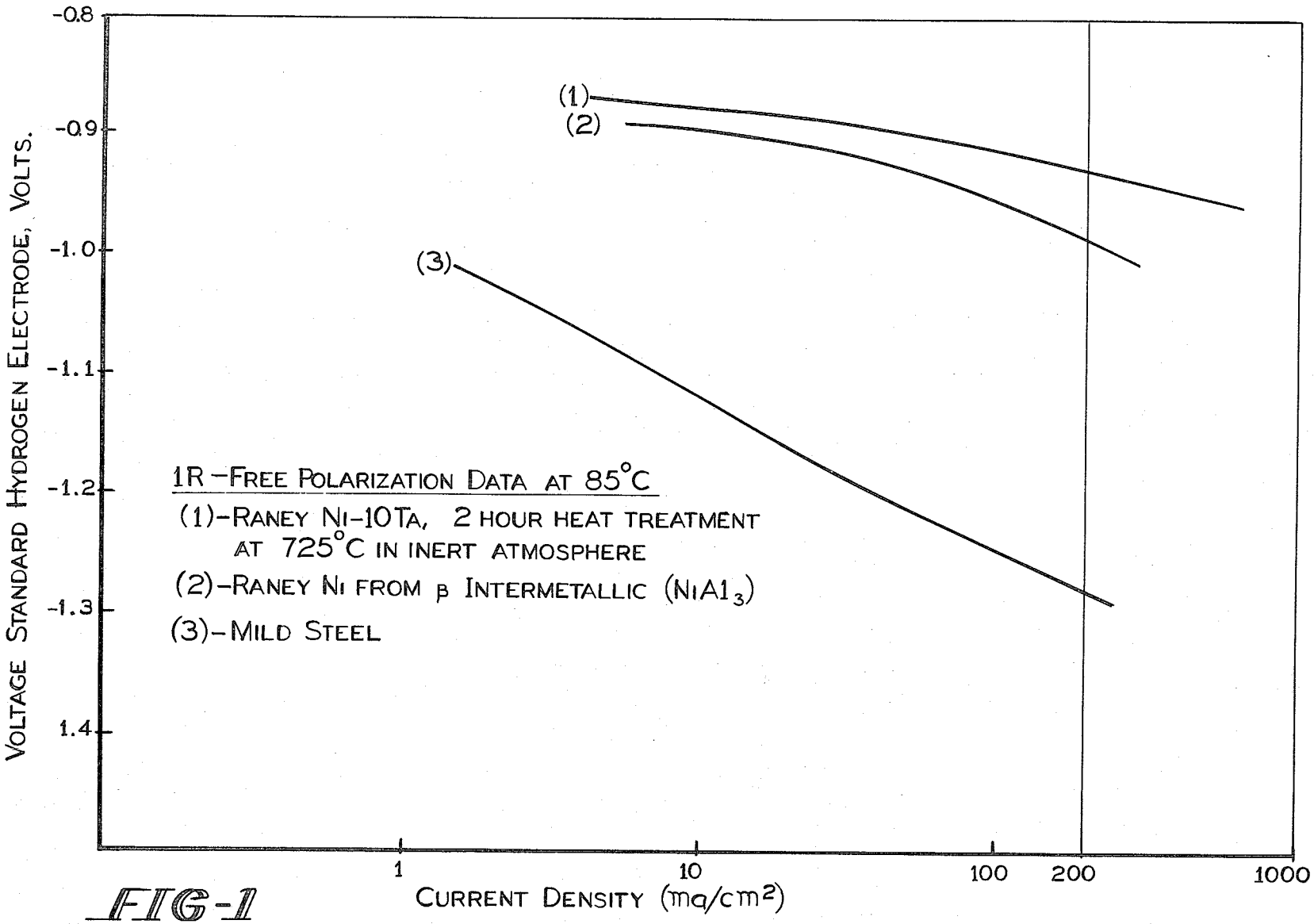
FIG. 1 is a graph of a series of curves of polarization potential versus time for a Raney Ni-Ta cathode of the present invention as compared with a Raney nickel cathode prepared from a Beta form of $NiAl_3$ alone, and with a mild steel cathode.

FIG. 1 shows the overpotential curves versus current density for two catalytically coated cathodes and a conventional mild steel cathode. Curve (1) shows the overpotential of a Raney-nickel-tantalum cathode (10% by weight tantalum) of the present invention and Curve (2) shows the overpotential for a Raney nickel electrode derived from the Beta phase ($NiAl_3$) which did not contain tantalum. Each electrode was derived from a Beta phase intermetallic by the same method of dipping or depositing the molten aluminum prior to identical heat treatment for two hours at 725° C. The presence of about 10 percent by weight of tantalum in the alloy was found to produce, upon subsequent Raney treatment, a $\beta$-Raney Ni-10Ta cathode coating, which as shown in Curve (1) has about 60 millivolts less hydrogen overvoltage than that exhibited by a B-Raney Ni cathode free of tantalum [Curve (2)] at a current density of about 200 milliamps/$cm^2$. The test method was the same as in the parent U.S. Pat. No. 4,240,895. A comparative test was also made with a mild steel cathode. The overpotential for the mild steel cathode is shown in FIG. 1 at Curve (3). It can be seen from this FIGURE that the Raney-nickel-tantalum electrode of this invention, as shown in Curve (1) has about 350 millivolts less hydrogen overvoltage than mild steel at a current density of 200 milliamps per square centimeter. The difference in tantalum content is clearly responsible for the difference in potential between Curves (1) and (2) since all other parameters of the comparative tests were identical.

Figure 2:
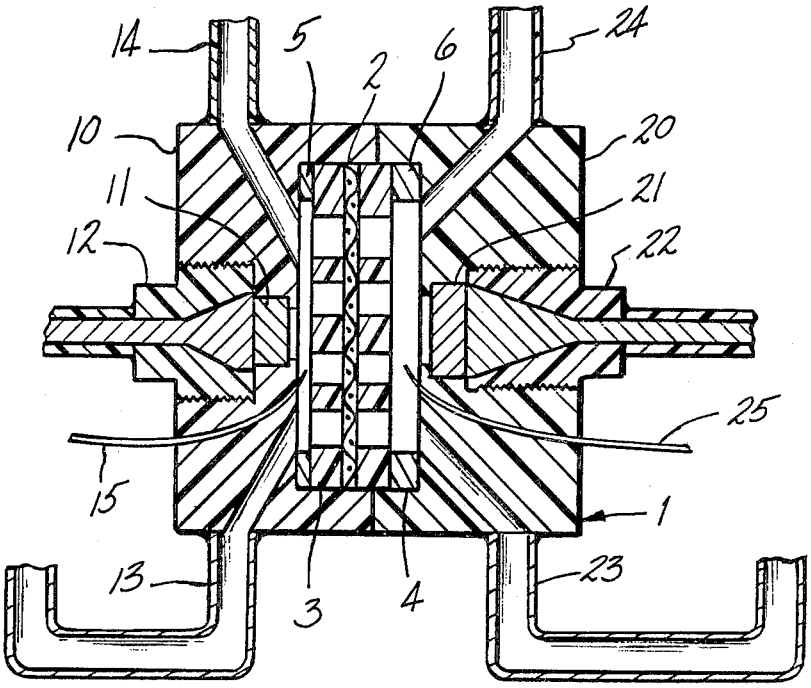
FIG. 2 is a sectional schematic view of a novel cell useful in the preparation of sodium hydroxide and chlorine from salt brine, which utilizes the cathode of this invention.

FIG. 2 is a sectional schematic diagram of an electrochemical cell, used for measuring the cathode potentials of the various cathode electrodes of the examples below.

Cell 1, made of tetrafluoroethylene ("TFE") or other suitable inert material, is divided by membrane 2 into two chambers, cathode chamber 10 and anode chamber 20. Porous membrane 2, which is placed between two TFE separators 3 and 4 sealed in place by caustic resistant gaskets 5 and 6, respectively.

A circular titanium anode 21 of two square centimeters area coated with a titanium oxide-ruthenium oxide mixed crystal is installed at the end of the anode current collector 22 in anode chamber 20. Cathode 11 of test cell 1 is installed at the end of cathode current collector 12 in cathode chamber 10. Perforated tetrafluoroethylene separators 3 and 4 and gaskets 5 and 6 are placed between membrane 2 and anode 21 and cathode 11, respectively.

A circular area of one square centimeter of the porous Raney nickel alloy surface, or other suitable metal is used as test cathode 11. Test cathode 11 is exposed to the interior of cathode chamber 10. Cathode 11 and anode 21 are connected electrically to a controllable voltage source (not shown) by cathode current collector 12 and anode current collector 22. An ammeter (not shown) is connected between the power source and the cathode. The entire cell 1 is then immersed in a liquid bath which is thermostatically controlled to give a constant operating temperature of about 85° C.

Catholyte, which typically is comprised of an aqueous solution containing about 11 weight percent sodium hydroxide, 15 weight percent sodium chloride and 0.1 weight percent sodium chlorate, (thereby simulating a diaphragm cell electrolyte), is pumped through inlet 13 into the cathode chamber 10 at a rate which establishes an overflow through outlet 14. Similarly, anolyte consisting of an aqueous brine solution having a pH of about 1.5 and containing about 24–26 weight percent sodium chloride, is pumped through inlet 23 into the anode chamber 20 and overflowed through outlet 24. The salt concentrations of the catholyte and anolyte are typical of that encountered in commercial diaphragm cells used in the electrolysis of brine. The use of separate catholyte and anolyte feeds, rather than a single brine feed, assures better control of the desired catholyte composition. The catholyte and anolyte flows are controlled so that there is a small flow of anolyte from anode chamber 20 through membrane 2 to cathode chamber 10, which flow is sufficient to assure ionic conductivity across the cell, but insufficient to significantly affect the catholyte composition.

Luggin tetrafluoroethylene capillary 15, installed in the cathode chamber 10 and Luggin capillary 25, installed in the anode chamber 20 are positioned about 0.5 mm from the membrane surface and are connected to a respective mercury-mercury oxide standard reference electrode or "S.C.E." (not shown), which in turn is connected through a voltmeter (not shown) to the other electrode of cell 10. All measurements were then converted to the standard hydrogen electrode (S.H.E.) form. A Luggin capillary is a probe which, in making ionic or electrolytic contact between the anode or cathode and the reference electrode, minimizes the voltage drop due to solution resistance and permits direct measurement of the anode or cathode potential with respect to the reference electrode.

To determine the cathode potential of a test electrode, a voltage is impressed between anode 21 and test cathode 11 to establish a current density, such as 200 ma/cm$^2$, at cathode 11. The current density is the current measured by the ammeter in milliamps divided by the cathode area (i.e., 1 cm$^2$) of the porous Raney nickel alloy surface of test cathode 11 exposed to catholyte. Thus 200 milliamperes are applied to cathode 11 to achieve a current density of 200 ma/cm$^2$. Hydrogen gas, generated at the cathode is removed from the cathode compartment though catholyte outlet 14. Chlorine gas, generated at anode 21, is similarly removed through anolyte outlet 24. The cell is operated in this manner for at least about 2 hours prior to reading the cathode potential directly from the voltmeter. A plurality of voltage readings are obtained at various current densities and utilizing various test cathodes 11 to obtain sufficient data to record curves (1)–(3).

More in detail, the foregoing objects are accomplished utilizing the novel cathode of this invention. A conductive metal structure or core comprised of an alloy of nickel and tantalum is used in preparing the novel cathode of this invention. The nickel-tantalum alloy contains from about 5 to about 25 and preferably from about 10 to about 20 weight percent of tantalum, and from about 75 to about 95, and preferably from about 80 to about 90 weight percent of nickel in the total combined weight of the alloy.

If desired, structures or cores of other metals or alloys may be employed and a nickel-tantalum coating of the above composition can be deposited by known techniques such as metal dipping, electroplating, electroless plating, and the like. When the core is of substantially pure nickel or an appropriate nickel bearing alloy such as Inconel 600, Hastalloy C or 310 stainless steel, the core inherently has a nickel bearing outer layer to which tantalum may then be added by electroplating, plasma spraying, or other suitable means. Where the nickel bearing material is a homogeneous alloy such as the above-identified nickel-tantalum alloy, it is most preferred to have the outer portions of the core (core is used interchangeably herein with substrate) itself serve as the nickel bearing outer layer. This helps eliminate or reduce spalling of the coating by eliminating or reducing the possibility of corrosion at the interface between the outer layer and core by making the interfacial transition much less abrupt. The nickel-tantalum alloy bearing outer layer of the core, whether provided by the core metal itself or as a deposited coating is conveniently at least 100 microns thick, and preferably at least 150 microns thick. The maximum thickness of this outer layer is a matter of convenience and economic choice.

Although cores or structures in the form of screens expanded metal, perforated plates, and the like are preferred, cores made from foils, wires, tubes, or expanded metal are also suitable.

Electrodes of the present invention are prepared by a process wherein an interdiffused nickel-tantalum-aluminum ternary alloy layer is formed on the core surfaces from which aluminum is subsequently selectively leached. This process includes the steps of (a) preparing a metallic core with a nickel bearing tantalum alloy outer layer, (b) aluminizing the surface of the core, (c) heat treating said aluminized nickel-tantalum alloy surface to diffuse aluminum into the alloy, (d) selectively leaching aluminum from the interdiffused material, (e) optionally chemically treating said leached surface to prevent potential pyrophoricity and (f) optionally coating said leached surface with nickel to improve its mechanical properties.

In performing this process the nickel tantalum bearing surface of the core must be thoroughly cleaned by conventional means such as chemical cleaning and/or grit blasting so as to improve the bond between the nickel-tantalum surface of the core and the subsequently applied aluminum layer.

The clean surface of the core is next subjected to an aluminizing treatment. By "aluminizing," as used herein is meant that aluminum is brought into intimate contact with the core surface so that when subsequently heated to promote interdiffusion the desired nickel-tantalum-aluminum ternary alloy layer is formed. Aluminizing can be accomplished by any of several known methods, such as plasma spraying aluminum onto the surface of the core, dipping the core into an aluminum melt or by use of fused salt electrolysis. Whichever method is used, an aluminum layer of at least about 100 microns thickness is deposited on the surface of the core. Much thicker aluminum layers, of, for example, greater than about 500 micron thicknesses, perform satisfactorily in the process but for reasons of economy, aluminum layer thicknesses of between about 150 to about 300 microns are preferred.

Dipping is the preferred technique used to apply the aluminum since it has been found to yield the lowest overvoltage coating upon subsequent Raney treatment and is the treatment most easily applied to expanded metal cathodes. Where this is done, the previously cleaned alloy surface is first coated with a low melting point flux typically comprised of potassium chloride, about 51 percent; lithium chloride, about 40 percent, and cryolite, about 9 percent by weight. This flux has a melting point of about 350° C. However, any suitable flux may be applied to the core surface.

The coated core is then dipped into a pot of molten aluminum held at a temperature in the range of between about 650° C. and about 675° C. for between about 0.5 and 2.0 minutes, said time being sufficient to uniformily coat the core with an aluminum thickness as defined above.

After aluminizing the core in this manner the coated core is then heat-treated to effect diffusion of the aluminum into the alloy.

Interdiffusion is carried out by heat treating the aluminized structure at a temperature in the range from about 660° to about 750° C. Preferably a temperature within the range of from about 700° C. to 750° C. is employed, and a temperature in the range from about 715° C. to about 735° C. is most preferred for heat treatment. Usually the interdiffusion is carried out in an atmosphere of hydrogen, nitrogen, or an inert gas. This interdiffusion treatment is continued for a time sufficient for the aluminum and nickel alloy to interdiffuse and form a nickel-tantalum-aluminum ternary alloy of between about 100 and about 400 microns in thickness, and preferably a thickness between about 150 and about 300 microns. Such thicknesses are obtained after a heat treatment period of between about 1 minute and 30 minutes, and preferably between about 5 to about 20 minutes. Under these conditions, the formation of the Beta phase, $(NiTa)Al_3$, is enhanced, and a minimum of Gamma phase structured material, $(NiTa)_2Al_3$, tends to form.

The thickness of the Gamma phase and the rate at which the Gamma phase grows are highly dependent on whether the aluminum layer is depleted, the length of the heat treatment, and the temperature at which the aluminum and nickel alloy are interdiffused. Larger grain sizes of the Gamma phase accompany the use of heat treatment temperatures in excess of about 750° C. When temperatures above about 860° C. are used Beta phase material transforms into liquid and Gamma phase material.

In addition, when there are nickel-tantalum for coatings on an underlying substrate differing in composition from the surface, extended heat treatment periods may damage the substrate and form undesirable brittle intermetallics at the coating-substrate interphase. For example, if aluminum is diffused into a nickel alloy coated steel core, excessive interdiffusion time or temperature can result in the aluminum "breaking through" to the steel base of the core, i.e., the aluminum diffuses all the way through the coating into the steel core. Breakthrough is accompanied by the formation of a very brittle $FeAl_3$ intermetallic phase which can significantly undermine the strength of the bond between the core and the interdiffused layer.

Also, if interdiffusion is continued too long, all of the available aluminum can be diffused into the nickel such that there is still a large excess of nickel in the interdiffused material. Under these latter circumstances, or when interdiffusion temperatures of above about 1000° C. are used, an intermetallic phase forms, which does not permit satisfactory subsequent leaching of the aluminum from the intermetallic, and consequently a highly active porous nickel does not form. By providing sufficient quantities of nickel alloy and aluminum with a heat treatment that avoids both an excessively long treatment time or an excessively high temperature during interdiffusion, both break-through and formation of these undesirable intermetallics are avoided.

Following the heat treating step, the aluminum coated core is cooled slowly in an inert atmosphere, such as nitrogen, to ambient temperature.

The formation of the desired nickel-tantalum-aluminum ternary alloy layer during the heat treating step is followed by a selective leaching step, wherein sufficient aluminum is removed from the surface and the nickel-tantalum-aluminum alloy layer forms a porous nickel-tantalum alloy surface layer. Generally, an aqueous solution of a strong base, such as NaOH, KOH or other strongly basic solution capable of dissolving aluminum is used in the selective leaching step. The selective leaching is generally carried out in an aqueous solution containing from about 1 to about 40% and preferably from about 10 to about 30% by weight of NaOH. The leaching treatment period is preferably from about 1 to about 3 hours, but may range from about 1 to about 24 hours, depending on the concentration. The leaching temperature is generally in the range from about 20° to about 100° C., and is preferably in the range from about 60° to about 80° C. Leaching conditions are employed to remove at least about 60%, and preferably from between about 75 to about 95% of the aluminum originally present in the interdiffused ternary alloy layer. The undissolved residue of aluminum preferably ranges from about 5 to about 25 percent by weight of the aluminum content prior to leaching. This treatment provides a porous nickel-tantalum alloy surface of unusually high electrochemical activity. It will be recognized by those skilled in the art that the leaching conditions can be varied from those mentioned above to achieve selective dissolution of the aluminum.

After the selective leaching, the active nickel alloy coating may exhibit a tendency to heat when exposed to air. This self-heating tendency could possibly lead to problems in pyrophoricity. However, an optional step of chemically treating the porous nickel layer can be used to eliminate this potential problem. Convenient methods for this chemical treatment include immersing the porous nickel surface for at least about 1 hour and usually less than about 4 hours in a dilute aqueous oxidizing solution containing, for example, (a) 5% $H_2O_2$, (b) 3% $NaNO_3$, (c) 3% $K_2Cr_2O_7$ or (d) 3% $NaClO_3$ and 10% NaOH by weight. These treatments eliminate the hot self-heating tendency of the porous-nickel-tantalum alloy surface without diminishing its electrochemical activity or mechanical properties.

The active porous Raney nickel-tantalum alloy surface layers, as prepared by the preceding steps have satisfactory mechanical properties and low tendency to spall, compared with many of the Raney nickel surfaces of the prior art. When tantalum is present in the Beta phase ($NiAl_3$) intermetallic aluminide according to the process of this invention, the Beta phase formation is stabilized. Tantalum is apparently captured in the order orthorhomic Beta phase crystal structure such that the Beta phase can be represented by the formula $(Ni_x\text{-}Ta_y)Al_3$ where x is in the range from about 75 to about 95 and y is within the range from about 5 to about 25 weight percent of the total weight of nickel and tantalum in the aluminide. By "stabilized" is meant that once the Beta phase forms it has less of a tendency to transform to a Gamma phase ($Ni_2Al_3$) crystal structure and thus the elevated heat treatment temperature can last longer without as much undesirable Gamma phase being formed. In fact, the heat treatment at the optimum temperature of about 725° C. can last from about 2 hours to about 6 hours, and still produce a B-Raney Ni-Ta cathode. A heat treatment period of two hours was used on the samples in FIG. 1. Since it was shown in the U.S. Pat. No. 4,240,895 that the Beta phase is the intermetallic of choice, this is an important advantage of the Ni-Ta-Al ternary alloy over Ni-Al binary alloys.

The novel electrode prepared by the process of this invention is useful as a cathode in electrolytic cells which utilize diaphragms, or liquid permeable membranes or liquid impermeable cation exchange membranes. Membranes which are useful in electrolytic cells for the electrolysis of brine which employ the novel cathode having the Raney nickel alloy surface described above, include perfluorosulfonic acid resins which are preferably hydrolyzed copolymers of a fluorinated vinyl compound and fluorosulfonated perfluorovinyl ether. Suitable fluorinated vinyl compounds include vinyl fluoride, hexafluoropropylene, vinylidene fluoride, trifluoroethylene, chlorotrifluoroethylene, perfluoro (alkylvinyl ether), tetrafluoroethylene and mixtures thereof. Preferred fluorinated vinyl compounds are tetrafluoroethylene and hexafluoropropylene, with tetrafluoroethylene being particularly preferred.

The fluorosulfonated perfluorovinyl ethers are compounds of the formula $CF_2{=}CFOR_fSO_2F$ wherein $R_f$ is a bifunctional perfluorinated radical comprising one to eight carbon atoms. The $R_f$ radical of the formula above can be either branched or unbranched, i.e., straight chain and can have one or more ether linkages.

Illustrative of such fluorosulfonated perfluorovinyl ethers are:

$$CF_2{=}CFOCF_2CF_2SO_2F,\ CF_2{=}CFOCF_2\underset{\underset{CF_3}{|}}{C}FOCF_2CF_2SO_2F,$$

$$CF_2{=}CFOCF_2\underset{\underset{CF_3}{|}}{C}FOCF_2\underset{\underset{CF_3}{|}}{C}FOCF_2CF_2SO_2F,$$

$$CF_2{=}CFCF_2CF_2SO_2F,\ \text{and}\ CF_2{=}CFOCF_2\underset{\underset{\underset{\underset{CF_3}{|}}{O}}{|}}{\overset{\overset{CF_2}{|}}{C}}FOCF_2CF_2SO_2F.$$

The most preferred fluorosulfonated perfluorovinyl ether is perfluoro(3,6-dioxa-4-methyl-7-octenesulfonyl fluoride), $$CF_2{=}CFOCF_2\underset{\underset{CF_3}{|}}{C}FOCF_2CF_2SO_2F$$

The fluorosulfonated perfluorovinyl ethers are disclosed in such references as U.S. Pat. No. 3,282,875, to Connolly et al.; U.S. Pat. No. 3,041,317, to Gibbs et al.; U.S. Pat. No. 3,560,568, to Resnick; and U.S. Pat. No. 3,718,627, to Grot.

The hydrolyzed copolymers are prepared by general polymerization techniques developed for homo- and copolymerizations of fluorinated ethylenes, particularly those employed for tetrafluoroethylene which are described in the literature.

The $FSO_2$ group of the solid persulfonic acid resin is converted to an $SO_3H$ group or a sulfonate group (such as an alkali metal sulfonate) or a mixture thereof. The equivalent weight of the perfluorocarbon copolymer ranges from about 900 to about 1,600 and preferably from about 1,100 to about 1,500. The equivalent weight is defined as the average molecular weight per sulfonyl group.

Perfluorosulfonic acid resins used as membranes may also contain substituents such as primary amines described, for example, in U.S. Pat. No. 4,085,071, issued on Apr. 18, 1978, to P. R. Resnick or polyamines as described, for example, in U.S. Pat. No. 4,030,988, issued June 21, 1977, to W. G. Grot.

Typically, perfluorosulfonic acid resin membranes suitable for electrolytic processes are homogeneous films having a thickness in the range of from about 1 to about 10 mils. For increased mechanical strength, the films are often combined, for example, by lamination with a support material. Fabrics of perfluoroolefins such as polytetrafluoroethylene material are commonly used as support materials.

Other suitable membranes are the carboxylic acid type such as disclosed in U.S. Pat. No. 4,065,366 which issued to Yoshio Oda et al. on Dec. 27, 1977. In this patent, carboxylic acid substituted polymers are prepared by reacting a fluorinated olefin with a comonomer having a carboxylic acid group or a functional group which can be converted to a carboxylic acid group.

The fluorinated olefin monomers and the comonomers having carboxylic acid group or a functional group which can be converted to carboxylic acid group for using the production of the copolymer for the membranes can be selected from the defined groups below.

It is preferable to use monomers for forming the units (a) and (b) in the copolymers.

$$\left(CF_2{-}CXX'\right) \quad \text{(a)}$$

$$\left(CF_2{-}\underset{\underset{Y}{|}}{C}{-}X\right) \quad \text{(b)}$$

wherein X represents 13 F, —Cl, —H or $—CF_3$ and X' represents —F, —Cl, —H, $—CF_3$ or $CF_3(CF_2)_m—$; m represents an integer of 1 to 5 and Y represents —A, —ϕ—A, —P—A, $—O—(CF_2)_n(P,Q,R—A$; P represents $—CF_2)_a(CXX')_b(CF_2)_c$; Q represents $—CF_2—O—CXX')_d$; R represents $—CXX'—O—CF_2)_e$; (P,Q,R) represents a discretional arrangement of at least one of P, Q and R; ϕ represents phenylene group; X,X' are defined above; n=0 to 1; a, b, c, d, and e represent 0 to 6; A represents —COOH or a functional group which can be converted to —COOH by hydrolysis or neutralization such as —CN, —COF, $—COOR_1$, —COOM, $—CONR_2R_3$; $R_1$ represents a $C_{1-10}$ alkyl group; M represents an alkali metal or a quaternary ammonium group and $R_2$ and $R_3$, respectively, represent hydrogen or a $C_{1-10}$ alkyl group.

The typical groups of Y have the structure having A connected to carbon atom which is connected to a fluorine atom, and include $$\left(CF_2\right)_x A,\ -O\left(CF_2\right)_x A,\ -O-CF_2-\underset{\underset{Z}{|}}{C}F\Big)_y A,$$

$$\left(O-CF_2-\underset{\underset{Z}{|}}{C}F-\right)_x\left(O-CF_2-CF\right)_y A,$$

$$-O-CF_2\left(\underset{\underset{Z}{|}}{C}F-O-CF_2\right)_x\left(CF_2\right)_y\left(CF_2-O-\underset{\underset{R_f}{|}}{C}F\right)_z A;$$

wherein x, y and z, are respectively, 1 to 10; Z and $R_f$ respectively, represent —F and a $C_{1-10}$ perfluoroalkyl group A is as defined above. In the case of the copolymers having the units (a) and (b), it is preferable to have 1 to 40, especially 30 to 20 mole percent of the unit (b) in order to produce the membrane having an ion-exchange capacity in said range. The molecular weight of the fluorinated copolymer is important because it relates to the tensile strength, the fabricapability, the water permeability and the electrical properties of the resulting fluorinated cation exchange membrane.

Typical carboxylic acid polymers include copolymer of tetrafluoroethylene and $$CF_2{=}CFO-CF_2{=}\underset{\underset{CF_3}{|}}{C}F-O(CF_2)_3-COOCH_3$$

prepared with a catalyst of azobisisobutyronitrile in trichlorofluoroethane to obtain a fluorinated copolymer having an ion exchange capacity of about 1.17 meq/g polymer and a $T_g$, glass transition temperature, of 190° C. press-molded to form a film about 200 microns thick and thereafter hydrolyzed in an aqueous methanol solution of sodium hydroxide, (b) a copolymer of tetrafluoroethylene and $CF_2{=}CFO—(CF_2)_3—COOH_3$ copolymerized with a catalyst of azobisisobutyronitrile to obtain a fluorinated copolymer having an ion exchange capacity of about 1.45 meq/g polymer and a $T_g$ of about 235° C., press-molded to form a film of thickness about 200 microns and hydrolyzed in aqueous methanol of sodium hydroxide, (c) a copolymer of tetrafluoroethylene and $$CF_2{=}CFO{-}(CF_2)_3COOCH_3 \quad (A)$$

$$CF_2{=}CFOCF_2CF(CF_3)O(CF_2)_3COOCH_3 \quad (B)$$

copolymerized with a catalyst of azobisisobutyronitrile (mole ratio A/B of about 4:1) to obtain a fluorinated copolymer having an ion exchange capacity of about 1.45 meq/g polymer and $T_g$ of about 220° C., press-molded to obtain a film of about 200 microns thickness, and hydrolyzed in an aqueous solution of methanol of sodium hydroxide, and (d) a copolymer of tetrafluoroethylene and $CF_2{=}CFO(CF_2)_3COOCH_3$ were copolymerized with a catalyst of ammonium persulfate in water to obtain a fluorinated copolymer having an ion exchange capacity of 1.20 meq/g polymer and $T_g$ of 210° C., the copolymer extruded to obtain a film having a thickness of 250 microns and width of B 15 centimeters and plied to a cloth made of a copolymer of tetrafluoroethylene and ethylene (50 mesh:thickness 150 microns), compress-molded to form a reinforced film and hydrolyzed in an aqueous methanol solution of sodium hydroxide to obtain a carboxylic acid type fluorinated cation exchange membrane.

Other suitable carboxylic acid type membranes are disclosed in South African Pat. No. 782225, which issued to David Charles England on Apr. 4, 1978, and U.S. Pat. No. 4,255,240, which issued on Mar. 10, 1981, to Molnar et al.

For selected laminated membranes, a laminated inert cloth supporting fabric may be employed. The thickness of the laminated inert cloth supporting fabric is in the range of from about 3 to about 7 and preferably from about 4 to about 5 mils. The inert supporting fabric is typically comprised of polytetrafluoroethylene, rayon, or mixtures thereof.

In each of the examples, electrodes are prepared and tested as cathodes in brine electrolysis test cells. Unless stated otherwise, all compositions are given as weight percentages.

EXAMPLE I

A nickel-tantalum alloy plate (10% tantalum) was rolled to sheet form having a thickness of about 0.020 inches. A disc having an area of approximately one square centimeter was cut from the sheet. The disc was thoroughly cleaned by degreasing with acetone, lightly etching with 10 percent HCl, rinsing with water and after drying, grit blasting with No. 24 grit $Al_2O_3$ at a pressure of 3.4 kg/cm$^2$ (50 psi).

The cleaned nickel-tantalum alloy disc was aluminized by applying a commercial flux and then dipping in a pot of molten aluminum at a temperature of about 675° C. for about one minute to entirely coat the coupon with aluminum.

The aluminized nickel-tantalum alloy disc was heat treated at about 725° C. for about 10 minutes in a nitrogen atmosphere to interdiffuse the aluminum and the nickel-tantalum alloy and form a layer which was predominantly Beta phase [$(NiTa)Al_3$] nickel-tantalum aluminide. After heat treating, the disc was allowed to cool in a current of nitrogen for about 2 hours. This produced a predominantly interdiffused layer of the Beta phase.

The cooled disc was then subjected to a caustic leaching treatment wherein the aluminum was selectively removed from the interdiffused layer to leave active porous Raney nickel-tantalum alloy surfaces on the disc. The leaching treatment comprised immersing the interdiffused disc in an aqueous 10 percent NaOH solution for about 20 hours, without temperature control, followed by 4 hours in an aqueous 30 percent NaOH solution at 100° C. The coupon was removed from the caustic and then rinsed with water for about 30 minutes.

The resulting disc was installed as cathode 11 in cell 1 of FIG. 2. The membrane used in the cell was a porous synthetic membrane comprised of a film of perfluorosulfonic acid resin which had been chemically modified by ethylene diamine converting a depth of about 1.5 mils to the perfluorosulfonamide, laminated with a "T-12" tetrafluoroethylene filament fabric marketed by DuPont under the trademark Nafion® 227. The cell was operated to produce chlorine and hydrogen by electrolysis of catholyte and anolyte of the composition set forth above in the discussion of FIG. 2. The temperature of the cell and its contents were maintained at about 85° C. during electrolysis.

The overvoltage of the novel cathode during electrolysis was measured at a variety of current densities and results are shown in Curve (1) of FIG. 1. At a current density of 200 ma/cm$^2$ the voltage was −0.93 volts.

For purposes of comparison, another disc was prepared, using the above procedure except the starting plate was comprised of nickel, and which did not contain tantalum. The relationship of overvoltage to current density for the Raney nickel-beta phase cathode is shown in FIG. 1 as Curve (2). At a current density of 200 ma/cm$^2$, the voltage was −0.99, which is an overvoltage of about 60 millivolts greater than that found for the novel nickel-tantalum cathode of this invention.

For purposes of further comparison, a mild steel disc was prepared of the same size and tested in the cell. The relationship of overvoltage to current density is shown in Curve (3) of FIG. 1. At a current density of 200 ma/cm$^2$, the voltage was −1.28 volts, an overvoltage of about 350 millivolts greater than that found for the novel nickel-tantalum cathode of this invention.

What is claimed is:

1. In a method for the electrolysis of brine to produce chlorine and an alkali metal hydroxide wherein an electric current is passed between an anode and a cathode in said cell containing an aqueous brine electrolyte and said anode is separated from said cathode by means of a separator, characterized by the improvement which comprises employing as said cathode a conductive metal core having an adherent porous nickel-tantalum alloy surface derived from the Beta phase aluminide of the formula $(NiTa)Al_3$.

2. The method of claim 1 wherein said conductive metal core is a nickel-tantalum alloy comprised of about 75 to about 95 percent by weight of nickel and from about 5 to about 25 weight percent of tantalum.

3. The method of claim 2 wherein said porous alloy surface contains from about 5 to about 25 percent by weight of tantalum.

4. The method of claims 2 and 3 wherein said alloy contains from about 10 to about 20 weight percent of tantalum.

5. An improved electrode for use as a hydrogen evolution cathode in an electrolytic cell comprised of a conductive metal core having an integral porous Raney nickel-tantalum alloy surface predominantly derived from the beta phase aluminide of the formula $(NiTa)Al_3$.

6. The electrode of claim 5 wherein said conductive metal core is a nickel-tantalum alloy comprised of from about 75 to about 95 percent nickel and from about 5 to about 25 percent tantalum by weight.

7. The electrode of claim 5 wherein said porous surface contains from about 5 to about 25 percent by weight of tantalum.

8. The electrode of claim 6 or 7 wherein said alloy contains from about 10 to about 20 weight percent of tantalum.

9. The electrode of claim 8 wherein said conductive metal core is expanded metal.

10. The electrode of claim 8 wherein said porous surface contains from about 5 to about 25 percent by weight of undissolved aluminum.

11. A method of producing a low overvoltage electrode for use as a hydrogen evolution cathode in an electrolytic cell which comprises the steps of:

(a) coating with molten aluminum the surface of a clean non-porous conductive base metal structure of a nickel-tantalum alloy containing from about 5 to about 25 weight percent of tantalum and from about 75 to about 95 weight percent of nickel;

(b) heat treating said coated surface at a temperature within the range from about 660° to about 750° C. for a time sufficient to diffuse a portion of said molten aluminum into outer portions of said structure to produce an integral nickel-tantalum-aluminum alloy layer in said outer portions consisting predominantly of the beta phase, $(NiTa)Al_3$, but insufficient time to create a predominance of $Ni_2Al_3$, the Gamma phase, in said outer portions; and (c) leaching out residual aluminum and intermetallics from the alloy layer in said outer portions until a porous Raney nickel-tantalum layer is formed integral with said structure.

12. The method of claim 11 wherein said heat treating time is from about 1 to about 30 minutes.

13. The method of claim 12 wherein said said temperature is maintained during said heat treating within the range from about 700° C. to about 750° C.

14. The method of claim 13 wherein said temperature is maintained during said heat treating within the range from about 715° C. to about 735° C.

15. The method of claim 11 wherein said coating is effected by dipping said structure into molten aluminum at a temperature within the range from about 650° to about 675° C. for from about 1 to about 2 minutes.

16. In an electrolytic cell useful for the electrolysis of brine to produce chlorine and an alkali metal hydroxide, said cell being comprised of an anode, a cathode, and a separator positioned between said anode and said cathode, characterized by the improvement which comprises employing as said cathode a conductive metal core having an adherent porous Raney nickel-tantalum surface derived from a Beta phase aluminite of the formula $(NiTa)Al_3$.

17. The electrolytic cell of claim 16 wherein said porous surface is a nickel-tantalum alloy comprised of from about 75 to about 95% by weight of nickel and from about 5 to about 25 percent by weight of tantalum.

18. The electrolytic cell of claim 5 wherein said conductive metal core is comprised of a nickel-tantalum alloy containing from about 5 to about 25 percent by weight of tantalum.

19. The electrolytic cell of claim 16, 17, or 18 wherein said separator is a cation exchange membrane selected from the group consisting of perfluorosulfonic acid resins and perfluorocarboxylic acid resins.

20. The electrolytic cell of claim 19 wherein said cation exchange separator is a perfluorosulfonic acid resin.

21. The electrolytic cell of claim 19 wherein said cation exchange separator is a perfluorocarboxylic acid resin.

22. The electrolytic cell of claim 19, 20, or 21 wherein said cation exchange separator is impervious to the flow of liquids.

* * * * *

UNITED STATES PATENT AND TRADEMARK OFFICE

CERTIFICATE OF CORRECTION

PATENT NO. : 4,384,932

DATED : May 24, 1983

INVENTOR(S) : Thomas J. Gray

It is certified that error appears in the above-identified patent and that said Letters Patent is hereby corrected as shown below:

Column 10, line 11, "13F," should read -- —F, --.

Column 10, line 67, "$CF_2{=}CFO{-}(CF_2)_3{-}COOH_3$" should read -- $CF_2{=}CFO{-}(CF_2)_3{-}COOCH_3$ --.

Column 11, line 24, delete "B".

Signed and Sealed this

First Day of May 1984

[SEAL]

Attest:

GERALD J. MOSSINGHOFF

Attesting Officer

Commissioner of Patents and Trademarks